US006976618B2

(12) United States Patent
Hallam

(10) Patent No.: US 6,976,618 B2
(45) Date of Patent: Dec. 20, 2005

(54) TUBULAR CARTONS

(75) Inventor: Christopher Hallam, Bradford (GB)

(73) Assignee: Concept Packaging Limited, Bradford (GB)

( * ) Notice: Subject to any disclaimer, the term of this patent is extended or adjusted under 35 U.S.C. 154(b) by 509 days.

(21) Appl. No.: 09/858,625

(22) Filed: May 16, 2001

(65) Prior Publication Data

US 2002/0185525 A1 Dec. 12, 2002

(30) Foreign Application Priority Data

May 20, 2000 (GB) ..... 0012342

(51) Int. Cl.[7] ..... B65D 3/00
(52) U.S. Cl. ..... 229/4.5; 229/5.5; 493/269; 493/276; 493/408
(58) Field of Search ..... 493/269, 276, 493/408; 229/4.5, 21, 5.5

(56) References Cited

U.S. PATENT DOCUMENTS

| | | | | | |
|---|---|---|---|---|---|
| 2,006,952 | A | * | 7/1935 | Klein | 229/4.5 |
| 2,226,178 | A | * | 12/1940 | Page | 229/5.5 |
| 3,912,331 | A | * | 10/1975 | Turner et al. | 229/4.5 |
| 3,918,629 | A | * | 11/1975 | Forbes et al. | 229/4.5 |
| 3,930,607 | A | * | 1/1976 | Smith | 229/5.5 |
| 4,051,992 | A | * | 10/1977 | Bergstein | 229/5.5 |
| 4,109,848 | A | * | 8/1978 | Kipp et al. | 229/4.5 |
| 4,934,591 | A | * | 6/1990 | Bantleon | 229/4.5 |
| 5,794,842 | A | * | 8/1998 | Hallam | 229/4.5 |

FOREIGN PATENT DOCUMENTS

| | | |
|---|---|---|
| DE | 3208682 | 9/1983 |
| EP | 0 007 539 | 7/1979 |
| EP | 0007539 A1 | 2/1980 |
| EP | 1000866 A2 | 5/2000 |
| GB | 2 038 276 | 7/1980 |
| GB | 2038276 A | 7/1980 |
| GB | 1600479 | 10/1981 |
| GB | 2298855 A | 9/1996 |

* cited by examiner

*Primary Examiner*—John Sipos
*Assistant Examiner*—Michelle Lopez
(74) *Attorney, Agent, or Firm*—Adams Evans P.A.

(57) ABSTRACT

The present invention provides a tubular carton sleeve (3) comprising a first sheet (4) superimposed at least in part on a second sheet (6), said first sheet providing an inner wall (4) of said sleeve and said second sheet providing an outer wall (6) of said sleeve, first and second opposing ends of said first and second sheets being interengaged to provide a join, wherein at said join, the first end (16) of said inner wall is in a face to face relationship with the second end (10) of said inner wall and the first end (28) of said outer wall is in a face to face relationship with the second end (12) of said outer wall. A corresponding tubular carton is also disclosed.

27 Claims, 3 Drawing Sheets

TUBULAR CARTONS

FIELD OF THE INVENTION

The present invention relates to tubular cartons.

BACKGROUND OF THE INVENTION

Tubular cartons made from card, and the like, have been in use for many years. There are a variety of different ways of forming the sleeve of a tubular carton, and cartons produced by helically winding a strip of cardboard around a former have been in use for many years.

In order to make manufacture easier and cheaper, the carton sleeve has more recently been made from a flat blank that is rolled to form the sleeve.

European patent application number 0 007 539 A1 discloses a tubular carton sleeve made from an inner and outer layer of material, the inner layer being narrower than the outer layer, but both layers being the same length.

The inner layer is superimposed on the outer layer slightly off set of the outer layer, such that a proportion of the end of the inner layer protrudes past the end of the outer layer and a corresponding proportion of the outer layer protrudes past the other end of the inner layer.

The longitudinal edges of the outer layer are folded over the narrower inner layer, to provide a neat finish to the ends of the sleeve. The thus joined sheets are then rolled to form the sleeve. The protruding section of inner layer forms a tab which is secured to the inner surface of the protruding section of the outer layer, and thus the ends of the sheets are joined together to form the sleeve.

UK patent application number GB -A- 2 038 276 discloses an alternative means of joining the edges of a tubular carton sleeve.

The blank of GB -A- 2 038 276 is produced from a single layer of cardboard material, which is folded to provide a double layered wall of the sleeve. The fold line of the blank is slightly offset from the centre of the sheet, so that when the sheet is folded one end of the sheet protrudes past the other end of the sheet to form a tab.

The folded sheet is then rolled to form a tube and the tab overlaps the folded edge of the sheet to form a join. End closures are applied to each end of the sleeve using a conventional rim rolling method. However, when the end closures are attached to the ends of the sleeve the increased thickness of the tube in the region of the join causes the material to distort.

In order to overcome this problem, a notch is removed from the edge of the blank in the region of the join. Therefore, when the blank is rolled and joined there is the same thickness of material all the way round the end of the sleeve in the region of application of the end closure, an a corresponding sleeve and tubular carton.

It is an aim of preferred embodiments of the present invention to provide an alternative blank for forming a sleeve of a tubular carton, and a corresponding sleeve and tubular carton.

SUMMARY OF THE INVENTION

The present invention provides a tubular carton sleeve comprising a first sheet superimposed at least in part on a second sheet, said first sheet providing an inner wall of said sleeve and said second sheet providing an outer wall of said sleeve, first and second opposing ends of said first and second sheets being interengaged to provide a join, wherein at said join, the first end of said inner wall is in a face to face relationship with the second end of said inner wall and the first end of said outer wall is in a face to face relationship with the second end of said outer wall.

Suitably, the inner wall at the first end comprises a first marginal flange extending along a portion of the edge thereof.

Suitably, the inner wall at the second end comprises a second marginal flange extending along a portion of the edge thereof.

Suitably, the second ends of the first sheet and the second sheet are connected together by means of a fold line. In this case, the second marginal flange of the inner wall may be provided by a cut out section of the outer wall extending along a portion of the fold line.

Suitably, the shape and dimensions of the first marginal flange corresponds with the shape and dimensions of the cut out section of the outer wall. In this case, when the ends of the sheets are interengaged to form the join, the first marginal flange suitably fits into the cut out section of the outer wall and the edge of the first marginal flange abuts the cut edge of the outer wall.

Suitably, the section of the edge of the first end of the inner wall which does not comprise the first marginal flange abuts the section of the edge of the second end of the inner wall which does not comprise the second marginal flange, when the ends of the sheets are interengaged.

If the second ends of the first and second sheets are joined together by a fold line, the edge of the first end of the inner wall, suitably abuts the fold line dividing the inner and outer wall, when the ends of the sheets are joined together.

Suitably, the first and second marginal flanges extend along the majority of the length of the edges of the first and second ends of the inner wall.

Suitably, when the ends of the first and second sheets are joined together to form the sleeve, the internal surface of the second marginal flange is in face to face relationship with the external surface of the inner wall.

Suitably, when the first and second sheets are superimposed on one another, the first end of the second sheet extends beyond the first end of the first sheet. Suitably, the first end of the second sheet extends beyond the first marginal flange.

When the first and second sheets are joined together to form the sleeve, the section of the outer wall which extends beyond the inner wall is suitably in a face to face relationship with the second end of the outer wall. Suitably, the interior surface of the first end of the outer wall is in face to face relationship with the exterior surface of the second end of the outer wall.

Suitably, the first and second sheets are substantially the same length. However, the first and second sheets may have different lengths, for example, in order to provide a means of neatening the ends of the sleeve.

The first and/or second sheet may comprise a further marginal flange extending along at least part of the longitudinal edge thereof. The further marginal flange may be folded over during assembly of the sleeve in order to neaten the end of the sleeve.

Furthermore, a further marginal flange may be provided along at least part of the longitudinal edge of the first and/or second sheet in order to provide a protrusion upon which a base can rest.

The further marginal flanges may be provided by a single continuous tab. Alternatively, the further marginal flanges may be provided by a series of smaller tabs, spaced apart from one another. The tabs may be generally rectangular or square in shape. Alternatively, the tabs may be generally triangular in shape.

Alternatively, a protrusion upon which a base may rest, may be provided by one or more cut-out sections in the inner wall of the sleeve. Suitably, the cut-out sections providing the base rest are located in the region of an end of the sleeve. Suitably, the cut-out sections providing the base rest are generally longitudinal in shape. Suitably, the cut-out sections providing the base rest extend about a substantial length of the inner periphery of the sleeve.

The present invention further provides a tubular carton comprising a tubular carton sleeve in accordance with the present invention.

The join may be provided by interengaging the first and second ends of the inner wall and the first and second ends of the outer wall in any suitable manner. The ends may be fixedly interengaged. Alternatively, the ends may be removeably engaged. The ends may be adhered to one another.

The present invention advantageously provides a tubular carton sleeve comprising a maximum overlap of only three layers of material at any point of the join.

The crossover of the first and second ends of the inner wall improves the strength of the join.

The present invention provides a join having a narrower join area along the length of the container, thereby reducing the distortion of the sleeve from a round cross sectional shape.

Longitudinal weakening lines may be provided at intervals around the periphery of the sleeve, to aid curving of the sleeve. Suitably, the weakening lines do not overlie the join region.

DESCRIPTION OF THE PREFERRED EMBODIMENT

Figure 1:
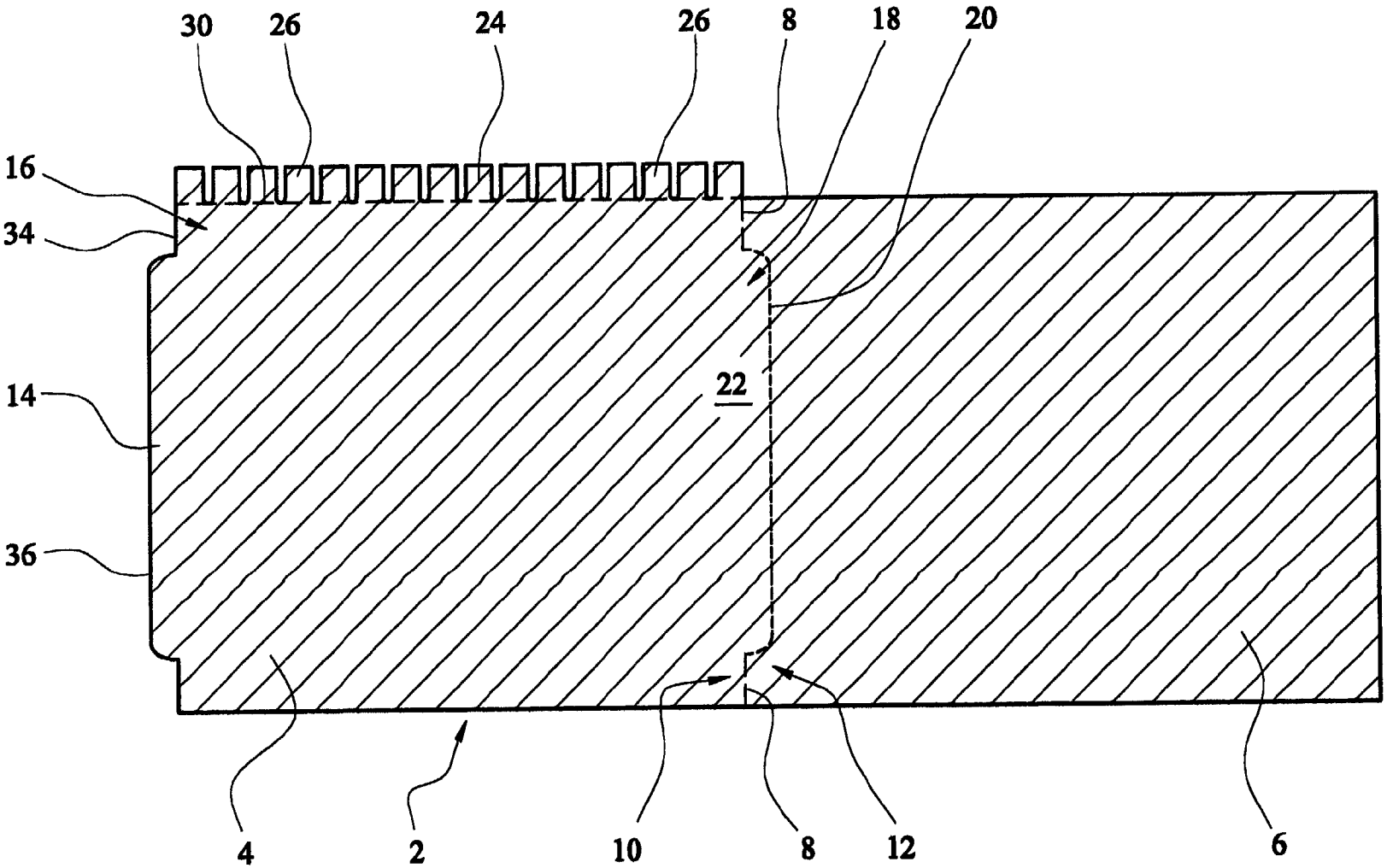
FIG. 1 is a schematic plan view of a sleeve blank shown from the inner side, in an unfolded condition.

FIG. 1 shows the interior surface of the blank 2. The blank 2 comprises an inner wall 4 and an outer wall 6, joined together at the second ends thereof, 10 and 12 respectively, by a fold line 8 (illustrated by a broken line).

The inner wall 4 comprises a first flange 14 provided at a first end 16 of said inner wall 4. The inner wall 4 comprises a second flange 18 provided by a cut out section 22 of the outer wall 6. The cut-out line of the outer wall 6, which provides the cut out section 22 is indicated in FIG. 1 by dotted line 20.

The inner wall 4 further comprises a further marginal flange 24, provided by a plurality of squares 26 longitudinally spaced from one another along the length of a longitudinal edge of the inner wall 4.

Figure 2:
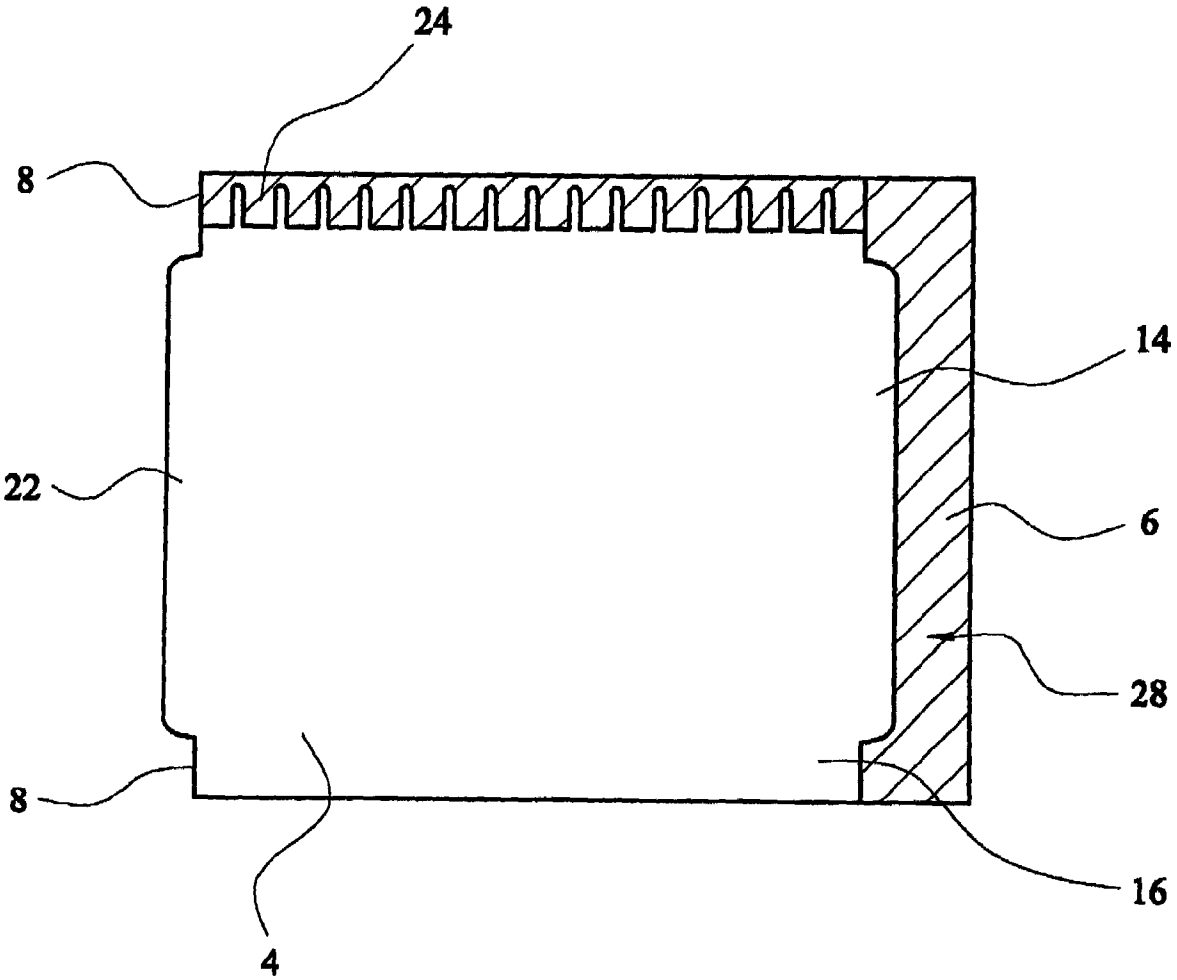
FIG. 2 is a schematic plan view of the blank of FIG. 1 in a folded condition.

FIG. 2 illustrates the blank of FIG. 1 in a folded condition. The blank is folded along fold line 8, so that the interior surface of the inner wall 4 is superimposed over at least part of the interior surface of the outer wall 6.

In the figures, the interior surface of the blank is indicated by the hatched areas and the exterior surface of the blank is indicated by the areas of the blank having no shading.

As can be seen from FIG. 2, when the inner wall 4 is superimposed on the outer wall 6 by folding along the fold line 8, the interior surface of the inner wall 4 contacts the interior surface of the outer wall 6.

Folding the blank 2 along the fold line 8, causes the cut out section of the outer wall 6 to be separated from the outer wall 6 and form the second flange 22 of the inner wall.

When the blank is folded along the fold line 8, the first end 28 of the outer wall 6 extends beyond the first flange 14 of the first end 16 of the inner wall 4.

The further marginal flange 24 of the inner wall 4 is folded along the fold line 30 (indicated by a broken line), such that exterior surface of the further marginal flange 24 contacts the exterior surface of the inner wall 4.

The further marginal flange 24 may be adhered to the inner wall 4 to provide a base rest of a container comprising a sleeve produced from the blank 2.

Figure 4:
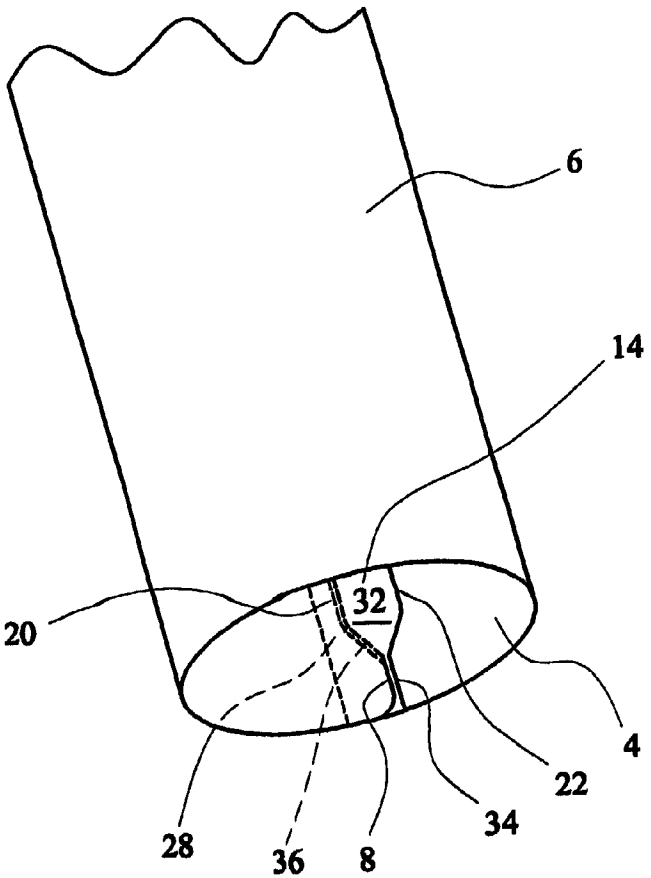
FIG. 4 is a schematic perspective view of part of the blank of FIGS. 1, 2 and 3 in the form of a sleeve.
Figure 3:
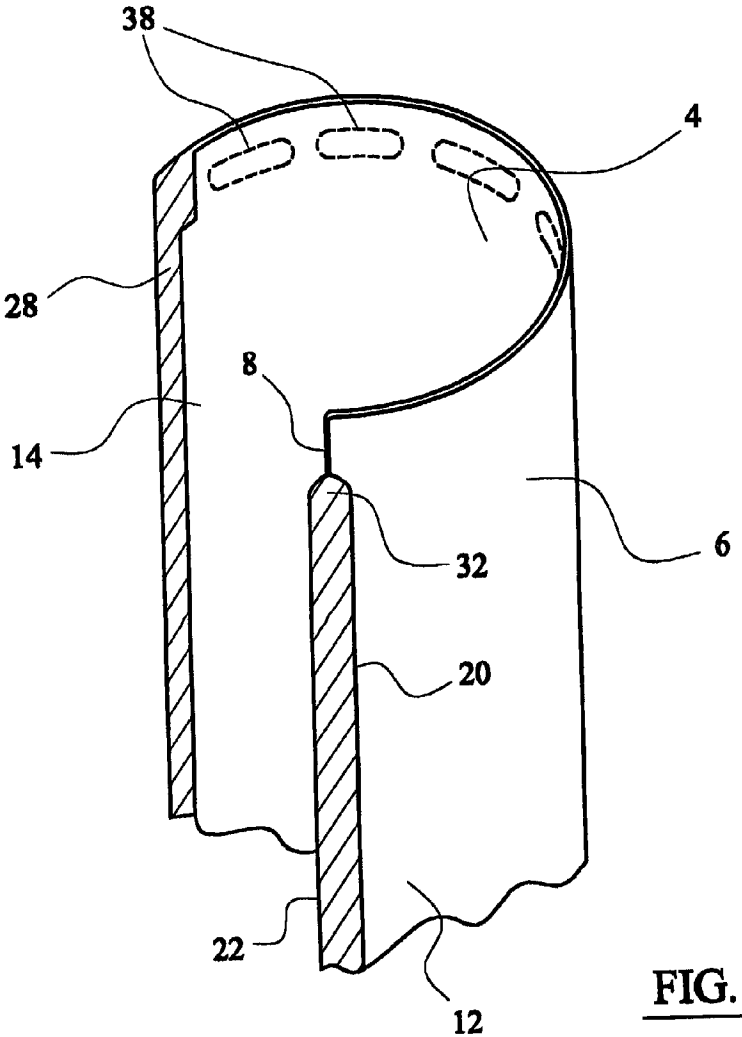
FIG. 3 is a schematic perspective view of part of the blank of FIGS. 1 and 2 in a partially rolled configuration.

FIGS. 3 and 4 show the blank of FIGS. 1 and 2 without the marginal flange 24 (for ease of explanation).

In order to make the blank into a sleeve for a tubular carton, the blank in the folded condition shown in FIG. 2, is rolled to bring the first ends 14, 28 of the inner wall 4 and the outer wall 6 towards the second ends 10,12 of the inner wall 4 and the outer wall 6 towards one another.

When the first and second ends 16, 28, 10, 12 of the inner 4 and outer 6 walls are contacted to form the join (as shown in FIG. 4):

the first flange 14 of the inner wall fits into the cut out space 32 of the outer wall 6, which cut out space 32 is produced once the second flange 22 is created by folding the blank along fold line 8. Therefore, the exterior surface of the first flange 14 contacts the interior surface of the second end 10 of the inner wall 4;

the interior surface of the first end 28 of the outer wall 6 overlaps the exterior surface of the second end 12 of the outer wall 6;

the interior surface of the second flange 22 contacts the exterior surface of the first end 16 of the inner wall 4;

the fold line 8 abuts the edge 34 of the first end 16 of the inner wall 4, and the edge 36 of the first flange 14 abuts the cut edge 20 of the outer wall 6, which cut edge 20 provides the second flange 22 of the inner wall 4.

As an alternative to the further marginal flange 24 provided by squares 26, one or both longitudinal ends of the inner wall 4 of the sleeve may comprise one or more cut out sections to provide a base rest (not shown). Suitable cut out sections 38 are illustrated by a dashed line in FIG. 3.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extend to any novel one, or any novel combination, of the features disclosed in this specification (including any accompanying claims, abstract and drawings), or to any novel one, or any novel combination, of the steps of any method or process so disclosed.

I claim:

1. A tubular carton sleeve comprising a first sheet superimposed at least in part on a second sheet, said first sheet providing an inner wall of said sleeve and said second sheet providing an outer wall of said sleeve, first and second opposing ends of said first and second sheets being interengaged to provide a join, the second ends of the first sheet and the second sheet being connected together by means of a fold line, the second ends of the first sheet and the second sheet further comprising a cut out line between the first sheet and the second sheet to form a cut-out space, wherein at said join, the first end of the inner wall is in a face to face relationship with the second end of said inner wall in said cut-out space and the first end of said outer wall is in a face to face relationship with the second end of said outer wall, and in which the inner wall at the second end comprises a second marginal flange extending along a portion of the edge thereof and protruding from the fold line in a direction away from the second end of the outer wall.

2. A tubular carton sleeve according to claim 1, wherein the first flange extends along less than the full length of an edge of the innerwall at the first end and the second flange extends along less than the full length of an edge of the inner wall at the second end.

3. A tubular carton sleeve according to claim 2, in which the section of the edge of the first end of the inner wall which does not comprise the first flange abuts the section of the edge of the second end of the inner wall which does not comprise the second flange, when the ends of the sheets are interengaged.

4. A tubular carton sleeve according to claim 1, in which the second flange of the inner wall is provided by a cut out section of the outer wail extending along a portion of the fold line.

5. A tubular carton sleeve according to claim 4, in which the shape and dimensions of the first flange correspond with the shape and dimensions of the cut out section of the outer wall.

6. A tubular carton sleeve according to claim 5, in which when the ends of the sheets are interengaged to form the join, the first flange fits into the cut out section of the outer waif and the edge of the first flange abuts the cut edge of the outer wall.

7. A tubular carton sleeve according to claim 5, in which the cut-out sections providing the base rest are located in the region of an end of the sleeve.

8. A tubular carton sleeve according to claim 5, in which the cut-out sections providing the base rest are generally longitudinal in shape.

9. A tubular carton sleeve according to claim 1, in which the first and second flanges extend along the majority of the length of the edges of the first and second ends of the inner wall.

10. A tubular carton sleeve according to claim 1, wherein the second marginal flange comprises an internal surface, and the inner wall of the first sheet comprises an external surface, in which when the ends of the first and second sheets are joined together to form the sleeve, the internal surface of the second marginal flange is in face to face relationship with the external surface of the inner wall.

11. A tubular carton sleeve according to claim 1, in which when the first and second sheets are superimposed on one another, the first end of the second sheet extends beyond the first end of the first sheet.

12. A tubular carton sleeve according to claim 1, in which the first end of the second sheet extends beyond the first flange.

13. A tubular carton sleeve according to claim 1, in which when the first and second sheets are joined together to form the sleeve, a section of the outer wall which extends beyond the inner wall is in face to face relationship with the second end of the outer wall.

14. A tubular carton sleeve according to claim 13, in which a first end of the outer wall comprises an interior surface, and a second end of the outer wall comprises an exterior surface, in which when the ends of the first and second sheets are joined together to form the sleeve, the interior surface of the first end of the outer wall is in face to face relationship with the exterior surface of the second end of the outer wall.

15. A tubular carton sleeve according to claim 1, in which the first and second sheets are substantially the same length.

16. A tubular carton sleeve according to claim 1, in which the first sheet comprises a marginal flange extending along at least part of the longitudinal edge thereof.

17. A tubular carton sleeve according to claim 16, in which the marginal flange is folded over during assembly of the sleeve.

18. A tubular carton sleeve according to claim 16, in which the marginal flange provides a protrusion upon which a base can rest.

19. A tubular carton sleeve according to claim 16, in which the marginal flange is provided by a single continuous tab.

20. A tubular carton sleeve according to claim 16, in which the marginal flange is provided by a series of smaller tabs, spaced apart from one another.

21. A tubular carton sleeve according to claim 1, in which the second sheet comprises a marginal flange extending along at least part of a longitudinal edge thereof.

22. A tubular carton sleeve according to claim 21, in which the marginal flange is folded over during assembly of the sleeve.

23. A tubular carton sleeve according to claim 21, in which the marginal flange provides a protrusion upon which a base can rest.

24. A tubular carton sleeve according to claim 21, in which the marginal flange is provided by a single continuous tab.

25. A tubular carton sleeve according to claim 21, in which the marginal flange is provided by a series of smaller tabs, spaced apart from one another.

26. A tubular carton sleeve according to claim 1, in which a protrusion upon which a base may rest, is provided by one or more cut-out sections in the inner wall of the sleeve.

27. A tubular carton sleeve according to claim 26, in which the cut-out sections providing the base rest extend about a substantial length of the inner periphery of the sleeve.

* * * * *

UNITED STATES PATENT AND TRADEMARK OFFICE

CERTIFICATE OF CORRECTION

PATENT NO. : 6,976,618 B2
APPLICATION NO. : 09/858625
DATED : December 20, 2005
INVENTOR(S) : Christopher Hallam It is certified that error appears in the above-identified patent and that said Letters Patent is hereby corrected as shown below:

Column 5, line 43, delete “wail” and enter --wall--.
Column 5, line 52, delete “waif” and enter --wall--.

Signed and Sealed this

Twenty-sixth Day of September, 2006

JON W. DUDAS
*Director of the United States Patent and Trademark Office*